US005394598A

United States Patent [19]

Kato

[11] Patent Number: 5,394,598

[45] Date of Patent: Mar. 7, 1995

[54] METHOD FOR DISMANTLING A CYLINDRICAL TANK

[75] Inventor: Hideo Kato, Oita, Japan

[73] Assignee: Kyuseki Kogyo Co., Ltd., Oita, Japan

[21] Appl. No.: 158,974

[22] Filed: Nov. 29, 1993

[51] Int. Cl.[6] ..... B23P 19/02

[52] U.S. Cl. ..... 29/426.4; 29/426.1

[58] Field of Search ..... 29/426.1, 426.2, 426.4, 29/426.5

[56] References Cited

U.S. PATENT DOCUMENTS

| | | | |
|---|---|---|---|
| 2,337,058 | 12/1943 | McKee | 29/402.03 |
| 4,965,922 | 10/1990 | Settlemier | 29/426.1 |
| 5,001,870 | 3/1991 | Yokota et al. | 29/426.3 |

FOREIGN PATENT DOCUMENTS

| | | | |
|---|---|---|---|
| 48-36711 | 5/1973 | Japan . | |
| 49-35780 | 9/1974 | Japan . | |
| 29614 | 3/1977 | Japan | 29/426.1 |
| 59-224774 | 12/1984 | Japan . | |
| 60-138172 | 7/1985 | Japan . | |
| 61-242263 | 10/1986 | Japan . | |
| 62-185965 | 8/1987 | Japan . | |

*Primary Examiner*—Mark Rosenbaum
*Assistant Examiner*—David P. Bryant
*Attorney, Agent, or Firm*—Christensen, O'Connor, Johnson & Kindness

[57] ABSTRACT

This invention relates to a method for dismantling a cylindrical tank, comprising steps of separating the sidewall of the tank from its bottom plate, cutting the sidewall into portions along a spiral line provided on the periphery of the tank in the direction from the lower end to the upper end, and removing the portions while temporarily supporting the sidewall, said temporary supporting step being conducted so that the lower end of the removed portion is gradually lowered and the location to support the sidewall shifts as the removing step proceeds. According to this invention, one can safely and inexpensively dismantle a cylindrical tank. The method of this invention can be used even if some structures exist in the peripheral area of the cylindrical tank. Further, this method does not need a step for providing rotatably movable means or a step for rotating the upper part of the tank, resulting in a simple method that is easy to implement.

5 Claims, 4 Drawing Sheets

METHOD FOR DISMANTLING A CYLINDRICAL TANK

RELATED APPLICATIONS

This is a continuation of International patent application Serial No. PCT/JP92/01576, filed Dec. 2, 1992, having a priority date based on Japanese application Serial No. 4-102,406/1992, filed Mar. 3, 1992, the benefit of the filing dates of which is claimed herein.

1. Field of the Invention

This invention relates to a method for dismantling a cylindrical tank, particularly to a method for dismantling a deteriorated cylindrical tank for storing oil, gas, water, et cetera.

2. Background of the Invention

Conventionally, to dismantle a cylindrical tank, one must construct a false work surrounding the tank, and using the false work, start to disjoin pieces in the upper part of the structure of the tank.

However, the method that starts from the step of disjoining pieces in the upper part of the structure inevitably includes work at elevated locations, and thus involves great risk. The method also requires the additional step of constructing a false work surrounding the tank, which makes the dismantling process expensive. Further, when there are other constructions near the tank, a false work is difficult to construct.

Thus, several methods for dismantling a cylindrical tank that starts from a step of disjoining pieces in the lower part of the tank are proposed.

For example, the Japanese TOKKYO-KOKAI-HOHO (18-month Publication of Unexamined Patent Application) SHOWA 62(1987)-185965 (hereinafter referred to as TOKKAISHO 62-185965) discloses a dismantling method comprising steps for cutting the cylindrical tank along a spiral line provided on the periphery of the sidewall in the lower part of the cylindrical tank and a cutting line connecting the starting and ending points of the spiral line, in order to divide the tank into upper and lower pieces; providing in the cutting portion along the spiral line means for rotatably supporting the upper piece of the tank; and for step-by-step removing the portions of the sidewall of the upper tank piece including the step portion of the cutting line in the form to extend the spiral line while rotating the upper piece of the tank so that the step portion of the cutting line moves toward the step portion of the cutting line.

The above method includes only work done at a spot near the ground and thus is safe. Since it does not need to construct a false work, it is also inexpensive. Further, this dismantling method is available even if some structures exist near the periphery of the tank.

However, the method disclosed in the Japanese TOKKAISHO 62-185965 needs an additional step for providing, in the spiral cutting portion along the spiral line, means for rotatably supporting the upper piece of the tank. This step is not easy to implement, and great efforts are required to provide such means in the cutting portion, because rotating the upper piece of the tank is difficult.

Accordingly, the object of this invention is to provide a dismantling method for a cylindrical tank, which method includes only safe work steps; which method is inexpensive; which method is available even if constructions exist near the periphery of the tank; and which method is easy to implement.

SUMMARY OF THE INVENTION

Means for solving the object of this invention will be described below.

First, this invention provides a method for dismantling a cylindrical tank, comprising steps of separating the sidewall of the tank from its bottom plate, cutting the sidewall into portions along a spiral line provided on the periphery of the tank in the direction from the lower end to the upper end, and removing the portions until the whole sidewall is removed.

Second, this invention provides a method for dismantling a cylindrical tank, comprising steps of separating the sidewall of the tank from its bottom plate, cutting the sidewall into portions along a spiral line provided on the periphery of the tank in the direction from the lower end to the upper end, and removing the portions while temporarily supporting the sidewall.

In said step for temporary supporting the sidewall, any means can be used for temporarily supporting the sidewall.

Such temporarily supporting means include not only jacks or the like but also means including support means as well as transfer means, for example, trucks having roller conveyers each comprising roller conveyers as supporting means and a truck as transfer means. A forklift or the like may be used.

Further, the supporting means does not need an additional supporting member because it is structured to mainly support the tank at the lower end of the sidewall. However, the supporting means can be so structured to support the sidewall via supporting members provided on the sidewall.

Third, this invention provides a method for dismantling a cylindrical tank, comprising steps of separating the sidewall of the tank from its bottom plate, cutting the sidewall into portions along a spiral line provided on the periphery of the tank in the direction from the lower end to the upper end, and removing the portions while temporarily supporting the sidewall, said temporarily supporting step being conducted so that the lower end of the removed portion is gradually lowered and the location of support of the sidewall shifts as the removing step proceeds.

After the sidewall of the tank is separated from the bottom plate, the sidewall is cut into portions along a spiral line provided on the periphery of the tank in the direction from the lower end to the upper end, and these portions are removed. When the part that has been cut into portions and removed is small, the lower end of the portion that remained of the sidewall supports the whole body of the tank.

When the part that has been cut into portions and removed is big, the balance of the whole body of the tank makes the tank inclined so that a section of the removed portion contacts the bottom plate. The lower end of the sidewall also supports the whole body of the cylindrical tank.

As the removing step proceeds, the balance of the whole body of the tank changes the location of the lower end of the removed portion of the sidewall that supports the whole body of the tank, in other words, the location where the removed portion of the sidewall and the bottom plate contact.

Therefore, as the removal step proceeds, the whole body of the tank other than the bottom plate is inclined a little at the same location, while the location where the removed portion of the sidewall and the bottom plate shifts along the periphery of the bottom plate. In short, the tank indicates a movement of braying in a mortar (so-called "misosuri" movement).

Since the method for dismantling a cylindrical tank of this invention includes only steps conducted at a spot near the ground, one can safely operate these steps. Since the method of this invention does not necessarily include the construction of a false frame, its operation cost is inexpensive. The method of this invention can be used even if some structures exist in the peripheral area of the cylindrical tank. Further, the balance of the whole body of the tank can be so controlled that the lower end of the removed portion of the sidewall supports the whole body. Thus, this method does not need a step for providing rotatably movable means or a step for rotating the upper part of the tank, resulting in a simple method that is easy to implement.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 1 shows the tank after the first portion is removed from the sidewall. FIG. 2 shows the tank in a tilted position. FIG. 3 shows the tank having a cutting line that extends around the entire periphery of the sidewall along which portions have been cut and removed from the sidewall.

DETAILED DESCRIPTION OF THE PREFERRED EMBODIMENT

By making reference to drawings, preferred embodiments of this invention will be described below.

In these drawings, 1 indicates a cylindrical tank; 2 and 2*a* indicate the sidewall of the cylindrical tank; 3 indicates the bottom plate; 4 indicates a cutting starting point; 5 indicates a line for cutting into the sidewall; 6 indicates a parallel joint; 7 indicates a jack; 8 and 8*a* indicate removed portions; 9 indicates a sidewall receiving piece; 10 indicates a truck having roller conveyers; 11 indicates roller conveyers; 12 indicates a truck; and 13 indicates a rail.

Figure 1:
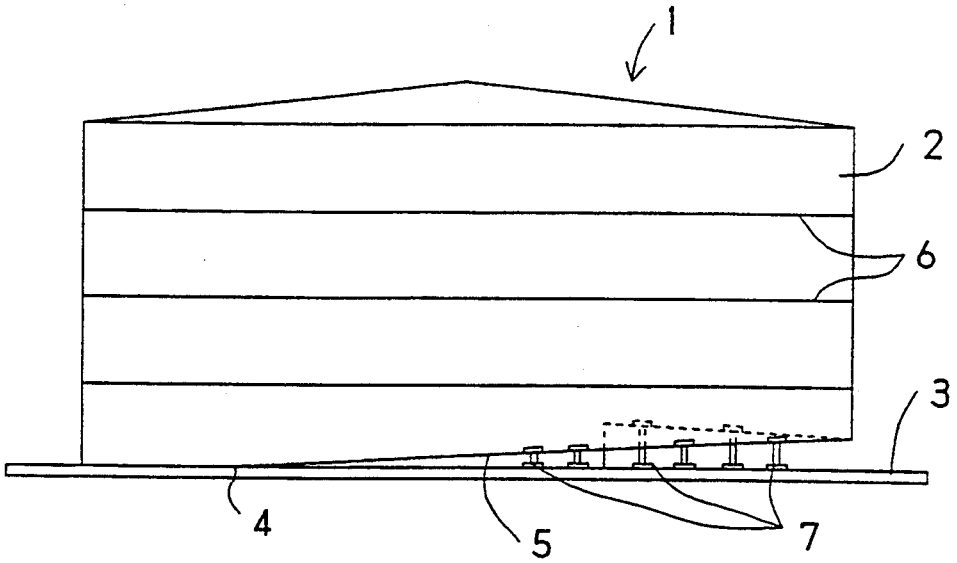
FIGS. 1 to 3 are schematic views of a cylindrical tank that is dismantled according to the steps of the method of this invention.

First, as shown in FIG. 1, the sidewall 2 of a cylindrical tank 1 is separated from the bottom plate 3. Separation of the tank 1 being the disconnection of the tank from the bottom plate 3.

A lower part of the sidewall 2 is then cut into portions along a spiral line provided on the periphery of the tank 1 as shown by the cutting line 5 starting from the cutting starting point 4 at the lower end of the sidewall 2 to the upper end. When the sidewall 2 is cut a little, it is further cut to go through to the lower end of the sidewall 2 to remove a portion. The lower part of the sidewall 2 is again cut along the spiral line, and another portion is removed by cutting through to the lower end of the sidewall 2.

If the removed portion is small, the whole body of the cylindrical tank 1 is supported at the lower end of the portion of the sidewall 2 that is not removed.

In FIG. 1, 6 indicates a parallel joint on the sidewall 2 of the cylindrical tank 1.

In this way, portions are repeatedly removed from the lower part of the sidewall 2; as shown in FIG. 1, jacks 7 are placed to temporarily support the lower end of the sidewall 2 to facilitate a further step of cutting and removing portions, and to keep the balance of the whole body of the tank 1.

Figure 2:
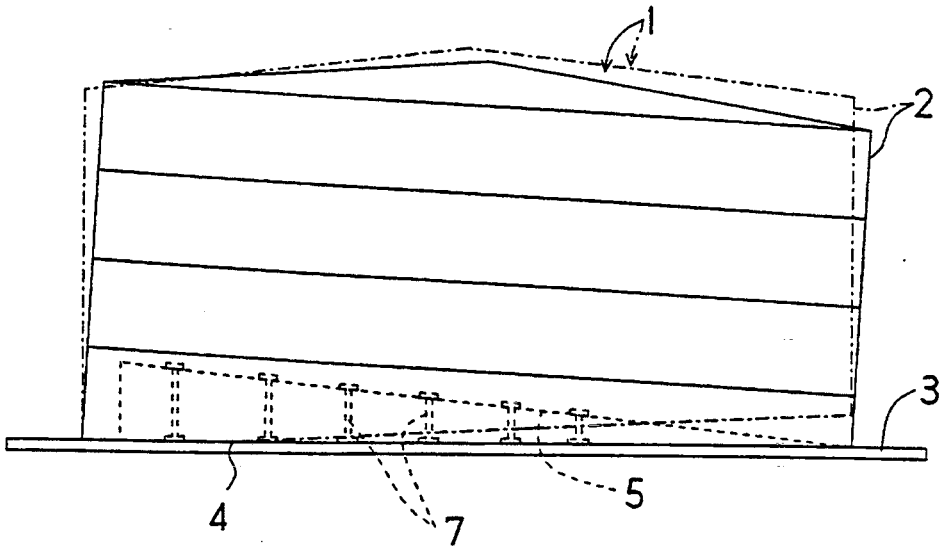

In turn, the jacks 7 placed beneath the portions that are removed at the beginning are lowered until they are removed, to lower the lower end of the sidewall 2 from which sidewall portions are removed. As shown in FIG. 2, the balance of the whole body of the tank 1 causes the tank 1 to be inclined to contact part of the removed portion of the sidewall 2 with the bottom plate 3. As a result, the tank 1 is also supported at the lower end of the removed portion of the sidewall 2.

As the removal step proceeds and jacks 7 are moved, the balance of the whole body of the tank 1 changes the location of the lower end of the removed portion supporting the whole body of the tank 1, in other words, the location where the removed portion of the sidewall 2 and the bottom plate 3 contact.

Therefore, as the removal step proceeds, the whole body of the tank 1 other than the bottom plate 3 is inclined a little at the same location, while the location where the removed portion of the sidewall 2 and the bottom plate 3 contact shifts along the periphery of the bottom plate 3. In short, the tank 1 indicates a movement of braying in a mortar (so-called "misosuri" movement).

Figure 3:
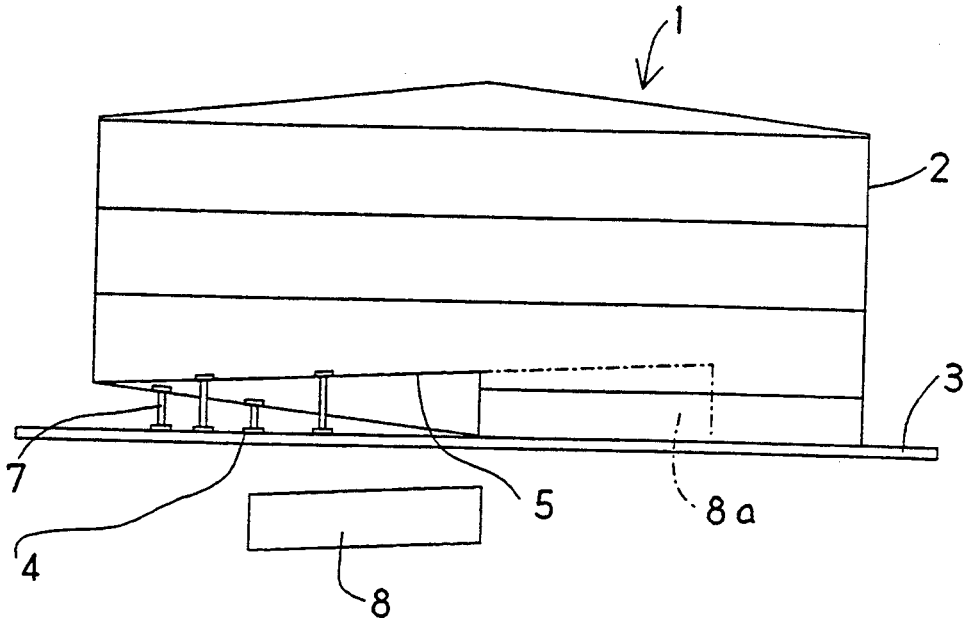

FIG. 3 indicates the tank 1 from which another portion 8 is removed after portions have been removed along the spiral cutting line 5 into the sidewall 2 extending over the whole periphery of the tank 1 to return to the starting point 4.

In FIG. 3, dotted line 8*a* indicates the portion that will be removed in the next step.

By repeating the above steps, the sidewall 2 of the tank 1 is gradually removed by cutting into portions along a spiral line and removing them from its lower part and then from the upper part until the whole tank 1 is completely divided into pieces.

By making reference to FIG. 4, the status of jacks 7 temporarily supporting the sidewall 2 will be explained below. Jacks 7 are placed on the periphery end of the bottom plate 3 to support the sidewall 2 via sidewall receiving pieces 9.

Figure 4:
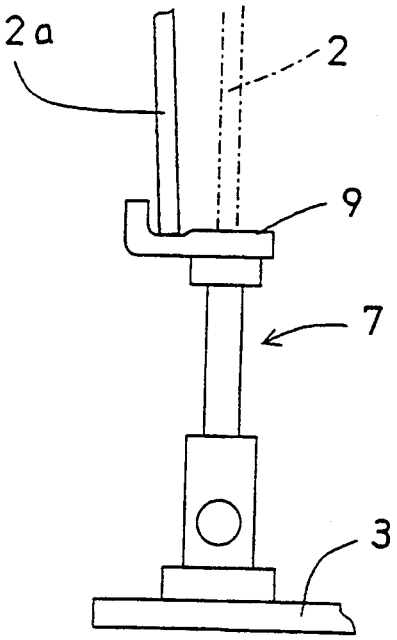
FIG. 4 shows a jack for temporarily supporting the sidewall.

In FIG. 4, 2*a* indicates the tilted sidewall.

Figure 5:
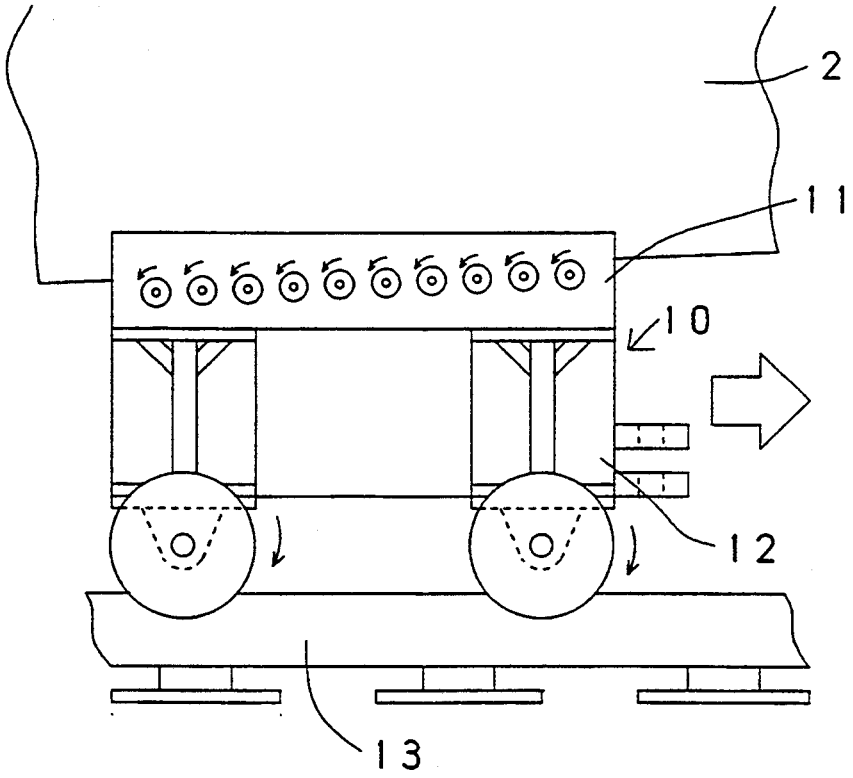
FIG. 5 shows the side view of a truck having roller conveyers for temporarily supporting the sidewall.
Figure 6:
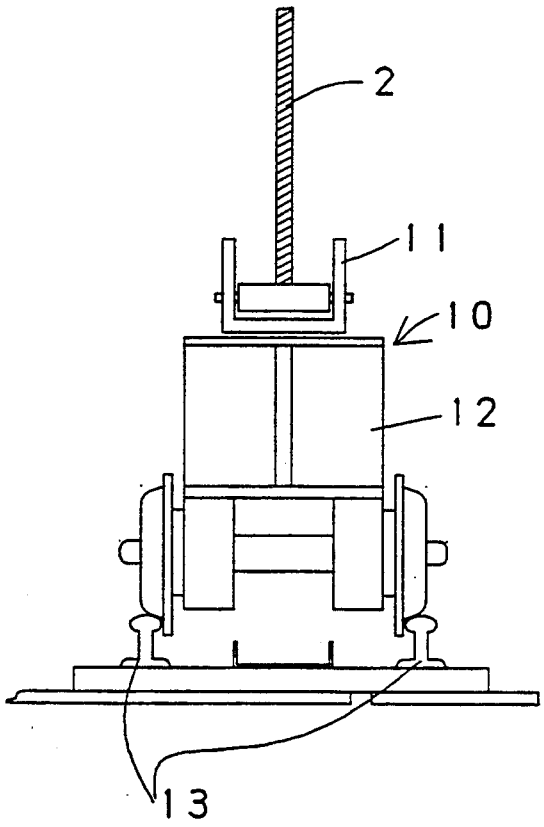
FIG. 6 shows the front view of a truck having roller conveyers for temporarily supporting the sidewall.

Further, FIGS. 5 and 6 indicate a truck having roller conveyers 10 supporting the sidewall 2. The truck having roller conveyers 10 comprises a truck 12 provided with roller conveyers 11 that engage with the rail 13 to support the sidewall 2.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method for dismantling a cylindrical tank having a sidewall and a bottom plate, the sidewall having a lower end and an upper end, said method comprising the steps of separating the sidewall of the tank from its bottom plate, cutting the sidewall into portions along a spiral line provided on the periphery of the tank in the direction from the lower end to the upper end, and removing the portions until the whole sidewall is removed, wherein said method is conducted without substantial rotation of said tank about a vertical axis.

2. A method for dismantling a cylindrical tank having a sidewall and a bottom plate, the sidewall having a lower end and an upper end, said method comprising the steps of separating the sidewall of the tank from its bottom plate, cutting the sidewall into portions along a spiral line provided on the periphery of the tank in the direction from the lower end to the upper end, and removing the portions while temporarily supporting the sidewall, wherein said method is conducted without substantial rotation of said tank about a vertical axis.

3. A method for dismantling a cylindrical tank having a sidewall and a bottom plate, the sidewall having a lower end and an upper end, said method comprising the steps of separating the sidewall of the tank from its bottom plate, cutting the sidewall into portions along a spiral line provided on the periphery of the tank in the direction from the lower end to the upper end, and removing the portions while temporarily supporting the sidewall at a support location, wherein said method is conducted without substantial rotation of said tank about a vertical axis, and said temporary supporting step is conducted so that the lower end of the sidewall, from which the sidewall portions are removed, is gradually lowered and the location to support the sidewall shifts as the removing step proceeds.

4. The method of claim 3, wherein the step of temporarily supporting the sidewall includes using a plurality of jacks positioned beneath the sidewall and lowering and shifting the jacks around the tank as the removal step proceeds.

5. The method of claim 3, wherein said step of temporarily supporting the sidewall includes moving at least one truck having roller conveyors beneath the sidewall as portions are removed.

* * * * *